US011308879B2

(12) United States Patent
Park et al.

(10) Patent No.: US 11,308,879 B2
(45) Date of Patent: Apr. 19, 2022

(54) ORGANIC LIGHT EMITTING DISPLAY DEVICE INCLUDING SCAN DRIVER

(71) Applicant: Samsung Display Co., Ltd., Yongin-si (KR)

(72) Inventors: Jong Won Park, Yongin-si (KR); Won Kyu Kwak, Yongin-si (KR); Seung Kyu Lee, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/103,769

(22) Filed: Nov. 24, 2020

(65) Prior Publication Data

US 2021/0082346 A1 Mar. 18, 2021

Related U.S. Application Data

(62) Division of application No. 15/870,378, filed on Jan. 12, 2018, now Pat. No. 10,861,386.

(30) Foreign Application Priority Data

Jun. 1, 2017 (KR) ..... 10-2017-0068490

(51) Int. Cl.
*G09G 3/32* (2016.01)
*G09G 3/3233* (2016.01)
(Continued)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC ..... G09G 3/30–3291; G09G 3/3233; G09G 3/3266; G09G 3/3275; G09G 2300/0426; G09G 2310/08; G09G 2320/0233
See application file for complete search history.

(56) References Cited

U.S. PATENT DOCUMENTS 8,803,770 B2 8/2014 Jeong et al.
8,942,339 B2 1/2015 Jang
(Continued)

FOREIGN PATENT DOCUMENTS

CN 102314829 A 1/2012
CN 105590585 A 5/2016
(Continued)

*Primary Examiner* — Roy P Rabindranath
(74) *Attorney, Agent, or Firm* — Innovation Counsel LLP

(57) ABSTRACT

An organic light emitting display device includes a pixel, a data line, a first scan line, a second scan line, and a scan driver. The pixel includes a first transistor, a second transistor, and a third transistor. A source of the first transistor is electrically connected to a drain of the third transistor. A source of the second transistor is configured to receive an initialization voltage. The data line is electrically connected to a source of the third transistor and may transmit a data voltage higher than the initialization voltage. The first scan line is electrically connected to a gate of the third transistor. The second scan line is electrically connected to a gate of the second transistor. The scan driver may provide an initializing scan signal to the second scan line at least two horizontal periods before providing an initial scan signal to the first scan line.

7 Claims, 13 Drawing Sheets

(51) Int. Cl.
*G09G 3/3266* (2016.01)
*G09G 3/3275* (2016.01)

(52) U.S. Cl.
CPC . *G09G 2300/0426* (2013.01); *G09G 2310/08* (2013.01); *G09G 2320/0233* (2013.01)

(56) References Cited

U.S. PATENT DOCUMENTS

| | | | | |
|---|---|---|---|---|
| 9,293,082 | B2 | 3/2016 | Jeon | |
| 9,325,311 | B1 * | 4/2016 | Konoshita | G09G 3/20 |
| 9,626,893 | B2 | 4/2017 | Kim | |
| 9,646,535 | B2 | 5/2017 | Yoon et al. | |
| 10,373,557 | B2 | 8/2019 | Zhu et al. | |
| 2006/0061560 | A1 | 3/2006 | Yamashita et al. | |
| 2007/0273619 | A1 | 11/2007 | Kitazawa et al. | |
| 2007/0273621 | A1 | 11/2007 | Yamashita et al. | |
| 2008/0036704 | A1 | 2/2008 | Kim et al. | |
| 2010/0020059 | A1 * | 1/2010 | Suh | G09G 3/3233 345/212 |
| 2011/0193856 | A1 | 8/2011 | Han | |
| 2012/0146969 | A1 * | 6/2012 | Sakamoto | G02F 1/13454 345/204 |
| 2013/0016804 | A1 | 1/2013 | Ahn et al. | |
| 2014/0111490 | A1 | 4/2014 | Lee et al. | |
| 2014/0111563 | A1 | 4/2014 | Hwang et al. | |
| 2015/0002558 | A1 | 1/2015 | Kumeta et al. | |
| 2015/0035735 | A1 | 2/2015 | Kang et al. | |
| 2015/0187320 | A1 | 7/2015 | Ren | |
| 2015/0364083 | A1 | 12/2015 | Jeon | |
| 2016/0005384 | A1 | 1/2016 | Yoon et al. | |
| 2016/0063922 | A1 | 3/2016 | Tsai et al. | |
| 2016/0133185 | A1 | 5/2016 | Yoon et al. | |
| 2016/0133190 | A1 | 5/2016 | Kim et al. | |
| 2017/0052635 | A1 | 2/2017 | Yu et al. | |
| 2017/0221411 | A1 * | 8/2017 | Chang | G09G 3/36 |
| 2018/0350300 | A1 | 12/2018 | Park et al. | |
| 2018/0374421 | A1 | 12/2018 | Chen et al. | |

FOREIGN PATENT DOCUMENTS

| | | | |
|---|---|---|---|
| KR | 10-2007-0111051 | A | 11/2007 |
| KR | 10-2008-0083379 | A | 9/2008 |
| KR | 10-2915-0007057 | A | 1/2015 |
| KR | 10-2015-0144882 | A | 12/2015 |
| KR | 10-2016-0055432 | A | 5/2016 |

* cited by examiner

ORGANIC LIGHT EMITTING DISPLAY DEVICE INCLUDING SCAN DRIVER

RELATED APPLICATION(S)

This application is a divisional application of U.S. patent application Ser. No. 15/870,378 filed Jan. 12, 2018, which claims priority to Korean Patent Application No. 10-2017-0068490, filed on Jun. 1, 2017, in the Korean Intellectual Property Office; the entire disclosure of the Korean Patent Application is incorporated by reference herein.

BACKGROUND

1. Field

The technical field relates to an organic light emitting display device and a driving method thereof.

2. Description of the Related Art

An organic light emitting display device displays images using an organic light emitting diode that generates light by recombination of electrons and holes. The organic light emitting display device may operate with a high response speed and with low power consumption.

A pixel of the organic light emitting display device includes an organic light emitting diode and a driving transistor for controlling the amount of current supplied to the organic light emitting diode. A characteristic (or characteristic curve) of the driving transistor may change corresponding to a data signal supplied during a previous frame period. As a result, an image with a desired luminance may not be properly displayed corresponding to a data signal supplied during a current frame period, and an undesirable instantaneous afterimage may occur.

SUMMARY

Embodiments may be related to an organic light emitting display device with desirable image display quality and may be related to a driving method of the organic light emitting display device.

According to an embodiment, an organic light emitting display device may include the following elements: pixels coupled to first scan lines, second scan lines, and data lines; and a scan driver configured to supply at least one scan signal to each of the first scan lines and supply a plurality of scan signals to each of the second scan lines, wherein the scan driver supplies a scan signal to a kth (k is a natural number) second scan line located on a kth horizontal line earlier by at least two horizontal periods than a scan signal supplied to a kth first scan line located on the kth horizontal line, wherein a pixel located on the kth horizontal line includes a driving transistor of which gate electrode is initialized to the voltage of an initialization power source, which is lower than that of a data signal, when the scan signal is supplied to the kth second scan line, and is supplied with the data signal from a data line when the scan signal is supplied to the kth first scan line.

The scan driver may include a plurality of stages. Each of the stages may supply, to an output terminal, a low voltage supplied to a third input terminal as the scan signal when a low voltage is supplied to each of first and second input terminals.

A first clock signal may be supplied to a second input terminal of a jth (j is 1, 5, 9, . . . ) stage, and a third clock signal may be supplied to a third input terminal of the jth stage; a second clock signal may be supplied to a second input terminal of a (j+1)th stage, and a fourth clock signal may be supplied to a third input terminal of the (j+1)th stage; the third clock signal may be supplied to a second input terminal of a (j+2)th stage, and the first clock signal may be supplied to a third input terminal of the (j+2)th stage; and the fourth clock signal may be supplied to a second input terminal of a (j+3)th stage, and the second clock signal may be supplied to a fourth input terminal of the (j+3)th stage.

The first to fourth clock signals may be sequentially supplied, and the phase of each of the first to fourth clock signals may be shifted by ¼ period as compared with a previously supplied clock signal.

A gate start pulse may be supplied to a first input terminal of each of first and second stages, and a scan signal of an (i−2)th stage may be supplied to a first input terminal of an ith (i is a natural number of 3 or more) stage.

A scan signal of a (k−2)th stage may be supplied to the kth second scan line, and a scan signal of a kth stage may be supplied to the kth first scan line.

A scan signal of a (k−3)th stage may be supplied to the kth second scan line, and the scan signal of the kth stage may be supplied to the kth first scan line.

The scan driver may further include a plurality of auxiliary stages. Each of the auxiliary stages may supply, to an output terminal, a low voltage supplied to a third input terminal as the scan signal when a low voltage is supplied to each of first and second input terminals.

A scan signal of the jth stage may be supplied to a first input terminal of a jth auxiliary stage, the third clock signal may be supplied to a second input terminal of the jth auxiliary stage, and the first clock signal may be supplied to a third input terminal of the jth auxiliary stage; a scan signal of the (j+1)th stage may be supplied to a first input terminal of a (j+1)th auxiliary stage, the fourth clock signal may be supplied to a second input terminal of the (j+1)th auxiliary stage, and the second clock signal may be supplied to a third input terminal of the (j+1)th auxiliary stage; a scan signal of the (j+2)th stage may be supplied to a first input terminal of a (j+2)th auxiliary stage, the first clock signal may be supplied to a second input terminal of the (j+2)th auxiliary stage, and the third clock signal may be supplied to a third input terminal of the (j+2)th auxiliary stage; and a scan signal of the (j+3)th stage may be supplied to a first input terminal of a (j+3)th auxiliary stage, the second clock signal may be supplied to the (j+3)th auxiliary stage, and the fourth clock signal may be supplied to a third input terminal of the (j+3)th auxiliary stage.

The scan signal of the kth stage may be supplied to the kth second scan line, and a scan signal of a kth auxiliary stage may be supplied to the kth first scan line.

The fourth clock signal may be supplied to the second input terminal of the jth auxiliary stage, and the second clock signal may be supplied to the third input terminal of the jth auxiliary stage; the first clock signal may be supplied to the second input terminal of the (j+1)th auxiliary stage, and the third clock signal may be supplied to the third input terminal of the (j+1)th auxiliary stage; the second clock signal may be supplied to the second input terminal of the (j+2)th auxiliary stage, and the fourth clock signal may be supplied to the third input terminal of the (j+2)th auxiliary stage; and the third clock signal may be supplied to the second input terminal of the (j+3)th auxiliary stage, and the first clock signal may be supplied to the third input terminal of the (j+3)th auxiliary stage.

An auxiliary gate start pulse may be supplied to the first input terminal of each of the first and second stages, and a scan signal of an (i−2)th auxiliary stage may be supplied to the first input terminal of the ith stage.

The scan signal of the kth stage may be supplied to the kth second scan line, and the scan signal of the kth auxiliary stage may be supplied to the kth first scan line.

According to an embodiment, a method of driving an organic light emitting display device may include the following steps: supplying a scan signal to a second scan line to allow a gate electrode of a driving transistor to be initialized to the voltage of an initialization power source, which is lower than that of a data signal; and supplying a scan signal to a first scan line to allow the voltage of the data signal to be stored in a pixel, wherein a plurality of scan signals are supplied to the second scan line, and the scan signal supplied to the second scan line is supplied earlier by at least two horizontal periods than the scan signal supplied to the first scan line.

An embodiment may be related to an organic light emitting display device. The organic light emitting display device may include a pixel, a data line, a first scan line, a second scan line, and a scan driver. The pixel may include a first transistor, a second transistor, and a third transistor. A source electrode of the first transistor is electrically connected to a drain electrode of the third transistor. A source electrode of the second transistor is configured to receive an initialization voltage. The data line may be electrically connected to a source electrode of the third transistor and may transmit a data signal with a voltage higher than the initialization voltage. The first scan line may be electrically connected to a gate electrode of the third transistor. The second scan line may be electrically connected to a gate electrode of the second transistor. The scan driver may be electrically connected to each of the first scan line and the second scan line and may provide an initializing scan signal to the second scan line at least two horizontal periods before providing an initial scan signal to the first scan line. A length of each of the two horizontal periods may be equal to a duration of the initializing scan signal.

The scan driver may include a first stage. A first input terminal of the first stage may receive a first input signal. A second input terminal of the first stage may receive a first copy of a first clock signal. A third input terminal of the first stage may receive a first copy of a second clock signal. An output terminal of the first stage may output a first scan signal after the first input terminal of the first stage has received the first input signal and the second input terminal of the first stage has received the first copy of the first clock signal. The first scan signal may synchronize with and/or may be equal to at least one of the second clock signal and the initializing scan signal. The first clock signal and the second clock signal may be illustrated as CLK1 and CLK3 in drawing figures.

The scan driver may include a second stage, a third stage, and a fourth stage.

A first input terminal of the second stage may receive a second input signal. A second input terminal of the second stage may receive a first copy of a third clock signal. A third input terminal of the second stage may receive a first copy of a fourth clock signal. An output terminal of the second stage may output a second scan signal after the first input terminal of the second stage has received the second input signal and the second input terminal of the second stage has received the first copy of the third clock signal. The second scan signal may synchronize with and/or may be equal to the fourth clock signal. The third clock signal and the fourth clock signal may be illustrated as CLK2 and CLK4 in drawing figures.

A first input terminal of the third stage may receive a copy of the first scan signal. A second input terminal of the third stage may receive a second copy of a second clock signal. A third input terminal of the third stage may receive a second copy of a first clock signal. An output terminal of the third stage may output a third scan signal after the first input terminal of the third stage has received the copy of the first scan signal and the second input terminal of the third stage has received the second copy of the second clock signal. The third scan signal may synchronize with and/or may be equal to the first clock signal.

A first input terminal of the fourth stage may receive a copy of the second scan signal. A second input terminal of the fourth stage may receive a second copy of a fourth clock signal. A third input terminal of the fourth stage may receive a second copy of a third clock signal. An output terminal of the fourth stage may output a fourth scan signal after the first input terminal of the fourth stage has received the copy of the second scan signal and the second input terminal of the fourth stage has received the second copy of the fourth clock signal. The fourth scan signal may synchronize with and/or may be equal to the third clock signal.

The first to fourth clock signals may be sequentially supplied, and the phase of each of the second to fourth clock signals may be shifted by ¼ period as compared with a previously supplied clock signal.

The first input signal may be a first gate start pulse. The second input signal may be a second gate start pulse.

The output terminal of the first stage may be electrically connected to the second scan line. The output terminal of the third stage may be electrically connected to the first scan line.

The output terminal of the first stage may be electrically connected to the second scan line. The output terminal of the fourth stage may be electrically connected to the first scan line.

The scan driver further may include a plurality of auxiliary stages. An output terminal of each auxiliary stage of the auxiliary stages may provide a scan signal after a first input terminal of the auxiliary stage and a second input terminal have each received a signal. The scan signal may synchronize with and/or may be equal to a clock signal received by a third terminal of the auxiliary stage.

The auxiliary stages may include a first auxiliary stage, a second auxiliary stage, a third auxiliary stage, and a fourth auxiliary stage. The first input terminals of the first, second, third, fourth auxiliary stages may be respectively electrically connected to the output terminals of the first, second, third, fourth stages. The second input terminals of the first, second, third, fourth auxiliary stages may be respectively electrically connected to the third input terminals of the first, second, third, fourth stages. The third input terminals of the first, second, third, fourth auxiliary stages may be respectively electrically connected to the second input terminals of the first, second, third, fourth stages.

The output terminal of the first stage may be electrically connected to the second scan line. The output terminal of the first auxiliary stage may be electrically connected to the first scan line.

The auxiliary stages may include a first auxiliary stage, a second auxiliary stage, a third auxiliary stage, and a fourth auxiliary stage.

The second input terminal of the first auxiliary stage may receive a third copy of the fourth clock signal. The third input terminal of the first auxiliary stage may receive a third copy of the third clock signal.

The second input terminal of the second auxiliary stage may receive a third copy of the first clock signal. The third input terminal of the second auxiliary stage may receive a third copy of the second clock signal.

The second input terminal of the third auxiliary stage may receive a third copy of the third clock signal. The third input terminal of the third auxiliary stage may receive a third copy of the fourth clock signal.

The second input terminal of the fourth auxiliary stage may receive a third copy of the second clock signal. The third input terminal of the fourth auxiliary stage may receive a third copy of the first clock signal.

The first input terminal of the first auxiliary stage and the first input terminal of the second auxiliary stage may each receive a gate start pulse. The first input terminal of the third auxiliary stage may be electrically connected to the output terminal of the first auxiliary stage. The first input terminal of the fourth auxiliary stage may be electrically connected to the output terminal of the second auxiliary stage.

The output terminal of the first stage may be electrically connected to the second scan line. The output terminal of the first auxiliary stage may be electrically connected to the first scan line.

An embodiment may be related to a method of driving an organic light emitting display device. The organic light emitting display device may include a data line, a first scan line, a second data line, and a pixel electrically connected to each of the data line, the first data line, and the second data line. The method may include the following steps: supplying a data signal to the data line; supplying an initializing scan signal to the second scan line to allow a gate electrode of a driving transistor in the pixel to be initialized to a voltage of an initialization power source, which may be lower than a voltage of the data signal; and at least two horizontal periods after the initializing scan signal has been supplied to the second data line, supplying a scan signal to the first scan line to allow the voltage of the data signal to be stored in the pixel. A length of each of the two horizontal periods may be equal to a duration of the initializing scan signal.

DETAILED DESCRIPTION

Figure 1:
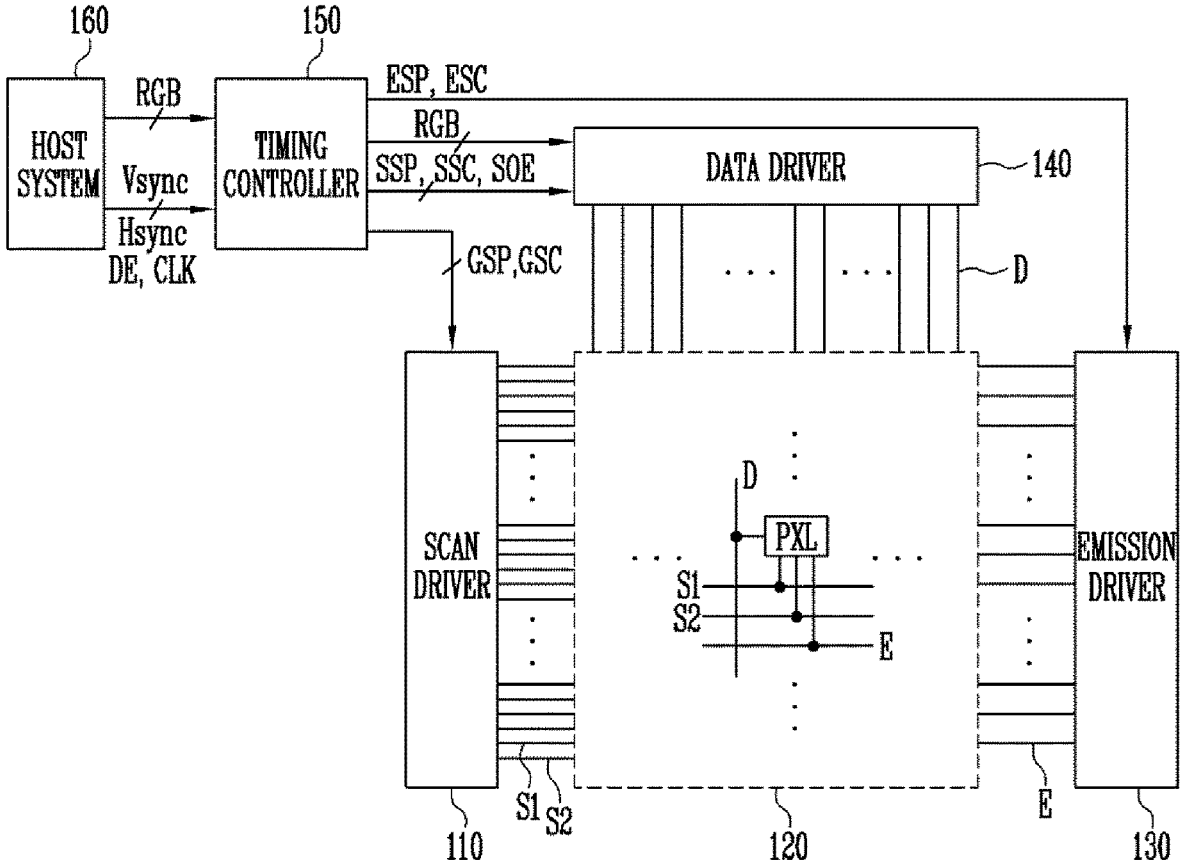
FIG. 1 is a diagram schematically illustrating an organic light emitting display device according to an embodiment.

Example embodiments are described with reference to the drawings by way of illustration. As those skilled in the art would realize, the described embodiments may be modified in various different ways. Accordingly, the drawings and description are to be regarded as illustrative in nature and not restrictive.

Although the terms "first," "second," etc. may be used herein to describe various elements, these elements, should not be limited by these terms. These terms may be used to distinguish one element from another element. Thus, a first element may be termed a second element without departing from teachings of one or more embodiments. The description of an element as a "first" element may not require or imply the presence of a second element or other elements. The terms "first," "second," etc. may also be used herein to differentiate different categories or sets of elements. For conciseness, the terms "first," "second," etc. may represent "first-type (or first-set)," "second-type (or second-set)," etc., respectively.

When a first element is referred to as being "connected" or "coupled" to a second element, the first element can be directly connected or coupled to the second element or can be indirectly connected or coupled to the second element with one or more intervening elements. Like reference numerals may refer to like elements.

FIG. 1 is a diagram schematically illustrating an organic light emitting display device according to an embodiment.

Referring to FIG. 1, the organic light emitting display device includes a pixel unit 120, a scan driver 110, an emission driver 130, a data driver 140, a timing controller 150, and a host system 160.

The pixel unit 120 includes a plurality of pixels PXL coupled to data lines D, first scan lines S1, second scan lines S2, and emission control lines E. The pixels PXL supply light with a predetermined luminance to the outside, corresponding to a data signal.

The data driver 140 generates a data signal by using image data RGB input from the timing controller 150. The data signal generated by the data driver 140 is supplied to the data lines D. The data driver 140 may be implemented with various types of circuits currently known in the art.

The scan driver 110 supplies a scan signal to the first scan lines S1 and the second scan lines S2. For example, the scan driver 110 may sequentially supply one or more scan signals to each of the first scan lines S1 and the second scan lines S2. In an embodiment, a scan signal supplied to a kth (k is a natural number) second scan line S2*k* located on a kth horizontal line (or kth pixel row) may be supplied earlier by two horizontal periods 2H than a scan signal supplied to a kth first scan line S1*k*.

The scan signal supplied from the scan driver 110 may be set to a gate-on voltage such that transistors included in the pixels PXL can be turned on. For example, the scan signal supplied from the scan driver 110 may be set to a low voltage, corresponding to a P-type transistor. A structure of the scan driver 110 will be described in detail later.

The emission driver 130 supplies an emission control signal to the emission control signals E. For example, the emission driver 130 may sequentially supply the emission control signal to the emission control lines E. If the emission control signal is sequentially supplied, the pixels PXL are sequentially set to a non-emission state. To this end, the emission control signal may be set to a gate-off voltage such that the transistors included in the pixels PXL can be turned off. The emission driver 130 may be implemented with various types of circuits currently known in the art.

The timing controller 150 supplies a gate control signal to the scan driver 110 and supplies a data control signal to the data driver 140, based on timing signals output from the host system 160, such as image data RGB, a vertical synchronization signal Vsync, a horizontal synchronization signal Hsync, a data enable signal DE, and clock signal CLK. Also, the timing controller 150 supplies an emission control signal to the emission driver 130.

The gate control signal includes a gate start pulse GSP and at least one gate shift clock GSC.

The gate start pulse GSP controls a start timing of the scan signal supplied from the scan driver 110. The gate shift clock GSC refers to at least one clock signal for shifting the gate start pulse GSP.

The emission control signal includes an emission start pulse ESP and at least one emission shift clock ESC. The emission start pulse ESP controls a start timing of the emission control signal. The emission shift clock ESC refers to at least one clock signal for shifting the emission start pulse ESP.

The data control signal includes a source start pulse SSP, a source sampling clock SSC, and a source output enable signal SOE. The source start pulse SSP controls a data sampling start time of the data driver 140. The source sampling clock SSC controls a sampling operation of the data driver 140, based on a rising or falling edge. The source output enable signal SOE controls an output timing of the data driver 140.

The host system 160 supplies image data RGB to the timing controller 150 through a predetermined interface. Also, the host system 160 supplies the timing controls Vsync, Hsync, DE, and CLK to the timing controller 150.

Figure 2:
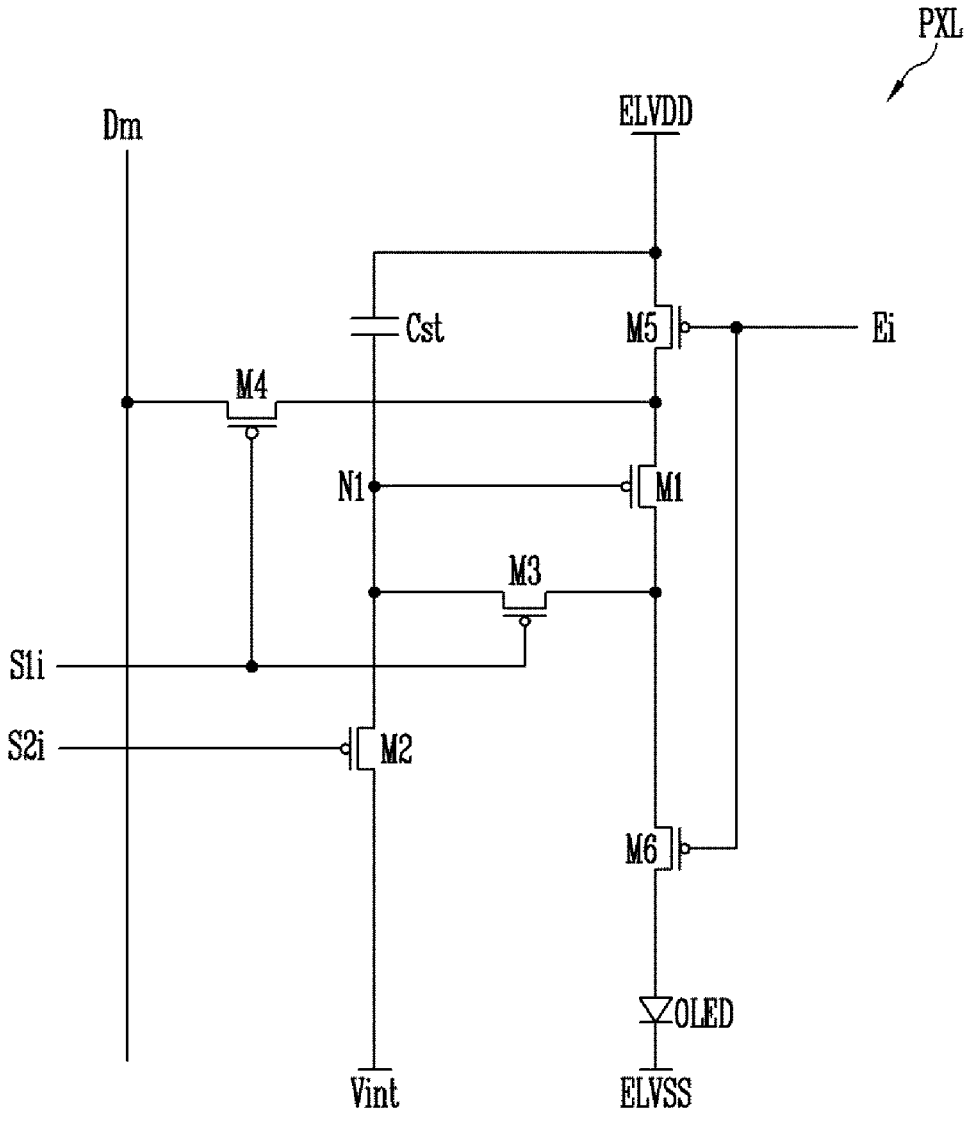
FIG. 2 is a circuit diagram illustrating an embodiment of a pixel shown in FIG. 1.

FIG. 2 is a circuit diagram illustrating an embodiment of the pixel shown in FIG. 1. For convenience of description, a pixel that is coupled to an mth data line Dm and is located on an ith (i is a natural number of 3 or more) horizontal line (or ith pixel row) is illustrated in FIG. 2.

Referring to FIG. 2, the pixel PXL includes first to sixth transistors M1 to M6 (each having a gate electrode, a first/source electrode, and a second/drain electrode), a storage capacitor Cst, and an organic light emitting diode OLED.

An anode electrode of the organic light emitting diode OLED is coupled to a second electrode of the first transistor M1 via the sixth transistor M6, and a cathode electrode of the organic light emitting diode OLED is coupled to a second power source ELVSS. The organic light emitting diode OLED generates light with a predetermined luminance corresponding to the amount of current supplied from the first transistor M1. To this end, a first power source ELVDD is set to a voltage higher than that of the second power source ELVSS.

A first electrode of the first transistor (or driving transistor) M1 is coupled to the first power source ELVDD via the fifth transistor M5, and the second electrode of the first transistor M1 is coupled to the anode electrode of the organic light emitting diode OLED via the sixth transistor M6. In addition, a gate electrode of the first transistor M1 is coupled to a first node N1. The first transistor M1 controls the amount of current flowing from the first power source ELVDD to the second power source ELVSS via the organic light emitting diode OLED, corresponding to a voltage of the first node N1.

The second transistor M2 is coupled between the first node N1 and an initialization power source Vint. In addition, a gate electrode of the second transistor M2 is coupled to an ith second scan line S2*i*. The second transistor M2 is turned on when a scan signal (or initializing scan signal) is supplied to the ith second scan line S2*i*, to supply the initialization voltage of the initialization power source Vint to the first node N1.

The initialization power source Vint is set to a voltage lower than that of a data signal. Therefore, if the voltage of the initialization power source Vint is supplied to the first node N1, the first transistor M1 is initialized to an on-bias state.

The third transistor M3 is coupled between the second electrode of the first transistor M1 and the first node N1. In addition, a gate electrode of the third transistor M3 is coupled to an ith first scan line S1*i*. The third transistor M3 is turned on when a scan signal is supplied to the ith first scan line S1*i*, to allow the second electrode of the first transistor M1 and the first node N1 to be electrically coupled to each other. Therefore, the first transistor M1 is diode-coupled when the third transistor M3 is turned on.

The fourth transistor M4 is coupled between the data line Dm and the first electrode of the first transistor M1. In addition, a gate electrode of the fourth transistor M4 is coupled to the ith first scan line S1*i*. The fourth transistor M4 is turned on when the scan signal is supplied to the ith first scan line S1*i*, to allow the data line Dm and the first electrode of the first transistor M1 to be electrically coupled to each other.

The fifth transistor M5 is coupled between the first power source ELVDD and the first electrode of the first transistor M1. In addition, a gate electrode of the fifth transistor M5 is coupled to an emission control line Ei. The fifth transistor M5 is turned off when an emission control signal is supplied to the emission control line Ei, and is turned on otherwise.

The sixth transistor M6 is coupled between the second electrode of the first transistor M1 and the anode electrode of the organic light emitting diode OLED. In addition, a gate electrode of the sixth transistor M6 is coupled to the emission control line Ei. The sixth transistor M6 is turned off when the emission control signal is supplied to the emission control line Ei, and is turned on otherwise.

In FIG. 2, it is illustrated that the second transistor M2 is coupled to the ith second scan line S2*i*. In an embodiment, the second transistor M2 is turned on earlier than the fourth transistor M4 to supply the voltage of the initialization power source Vint to the first node N1. To this end, the ith second scan line S2*i* may be set as a first scan line S1 located on a previous horizontal line (or previous pixel row). For example, the ith second scan line S2*i* may be set as an (i−2)th first scan line S1*i*-2 or an (i−3)th first scan line S1*i*-3.

The storage capacitor Cst is coupled between the first power source ELVDD and the first node N1. The storage capacitor Cst stores a voltage corresponding to the data signal.

Figure 3:
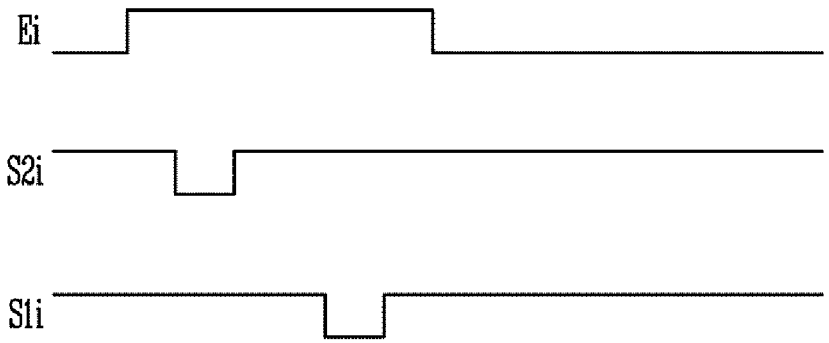
FIG. 3 is a waveform diagram schematically illustrating an embodiment of a driving method of the pixel shown in FIG. 2.

FIG. 3 is a waveform diagram schematically illustrating an embodiment of a driving method of the pixel shown in FIG. 2.

Referring to FIG. 3, first, an emission control signal is supplied to the emission control line Ei. If the emission control signal is supplied to the emission control line Ei, the fifth transistor M5 and the sixth transistor M6 are turned off. If the fifth transistor M5 is turned off, the first power ELVDD and the first transistor M1 are electrically cut off from each other. If the sixth transistor M6 is turned off, the first transistor M1 and the organic light emitting diode OLED are electrically cut off from each other. Therefore, the pixel PXL is set to the non-emission state during a period in which the emission control signal is supplied to the emission control line Ei.

Then, a scan signal is supplied to the ith second scan line S2*i*. If the scan signal is supplied to the ith second scan line S2*i*, the second transistor M2 is turned on. If the second transistor M2 is turned on, the voltage of the initialization power source Vint is supplied to the first node N1. If the voltage of the initialization power source Vint is supplied to the first node N1, the first transistor M1 is set to the on-bias state.

After the scan signal is supplied to the ith second scan line S2*i*, a scan signal is supplied to the ith first scan line S1*i*. If the scan signal is supplied to the ith first scan line S1*i*, the third transistor M3 and the fourth transistor M4 are turned on.

If the fourth transistor M4 is turned on, a data signal from the data line Dm is supplied to the first electrode of the first transistor M1.

If the third transistor M3 is turned on, the first node N1 and the second electrode of the first transistor M1 are electrically coupled to each other. At this time, since the first node N1 is initialized to the voltage of the initialization power source Vint, which is lower than that of the data signal, the first transistor M1 is turned on.

If the first transistor M1 is turned on, a voltage obtained by subtracting an absolute threshold voltage of the first transistor M1 from the voltage of the data signal is supplied to the first node N1. At this time, the storage capacitor Cst stores a voltage corresponding to the data signal and the threshold voltage of the first transistor M1.

After the voltage corresponding to the data signal and the threshold voltage of the first transistor M1 is stored in the storage capacitor Cst, the supply of the emission control signal to the emission control line Ei is stopped. If the supply of the emission control signal to the emission control line Ei is stopped, the fifth transistor M5 and the sixth transistor M6 are turned on. If the fifth transistor M5 is turned on, the first power source ELVDD and the first electrode of the first transistor M1 are electrically coupled to each other. If the sixth transistor M6 is turned on, the second electrode of the first transistor M1 and the anode electrode of the organic light emitting diode OLED are electrically coupled to each other.

At this time, the first transistor M1 controls the amount of current flowing from the first power source ELVDD to the second power source ELVSS via the organic light emitting diode OLED, corresponding to the voltage of the first node N1. Then, the organic light emitting diode OLED generates light with a predetermined luminance corresponding to the amount of current supplied from the first transistor M1. In an embodiment, the pixel PXL generates light with a predetermined luminance corresponding to the data signal while repeating the above-described process.

In an embodiment, the first transistor M1 is set to the on-bias state when the voltage of the initialization power source Vint is supplied to the first node N1. If the first transistor M1 is not set to the on-bias state for sufficient time, the characteristic curve of the first transistor M1 is not initialized to a certain state. Thus, in an embodiment, the first transistor M1 is set to the on-bias state for sufficient time by controlling the scan signal supplied from the scan driver 110, and accordingly, an image with satisfactory and/or uniform luminance is displayed.

Figure 4:
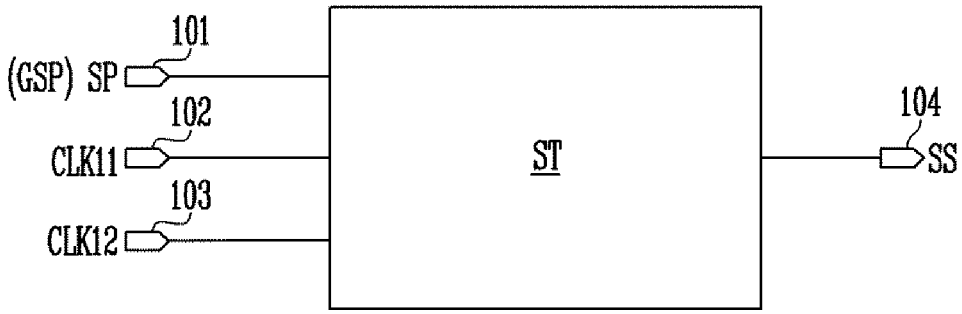
FIG. 4 is a diagram illustrating an embodiment of a stage included in a scan driver.

FIG. 4 is a diagram illustrating an embodiment of a stage included in the scan driver.

Referring to FIG. 4, the stage ST includes a first input terminal 101, a second input terminal 102, a third input terminal 103, and an output terminal 104.

The first input terminal 101 is supplied with a sampling pulse SP of a previous stage or a gate start pulse GSP. For example, when the stage ST is set as a first stage or a second stage, the gate start pulse GSP may be supplied to the first input terminal 101. When the stage ST is set as an ith stage, the sampling pulse SP may be supplied from an (i−2)th stage to the input terminal 101. In an embodiment, the sampling pulse SP is set as a scan signal output from the (i−2)th stage.

The second input terminal 102 is supplied with an eleventh clock signal CLK11.

The third input terminal 103 is supplied with a twelfth clock signal CLK 12. In an embodiment, the twelfth clock signal CLK12 may be set to have the same period as the eleventh clock signal CLK11 and have a shifted phase.

The output terminal 104 outputs a scan signal SS, corresponding to the signals supplied to the first to third input terminals 101 to 103.

Figure 5A:
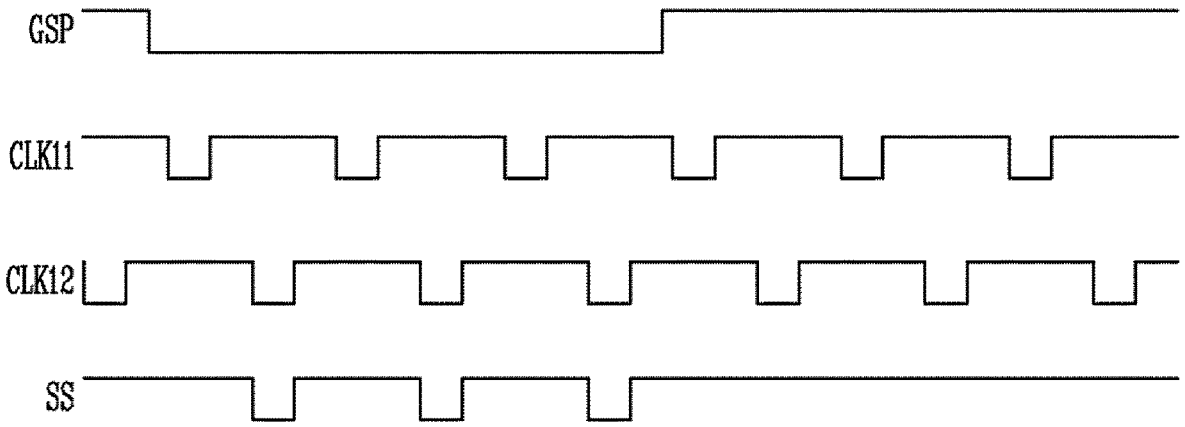
FIG. 5A and FIG. 5B are diagrams illustrating an operation process of the stage shown in FIG. 4 according to an embodiment.
Figure 5B:
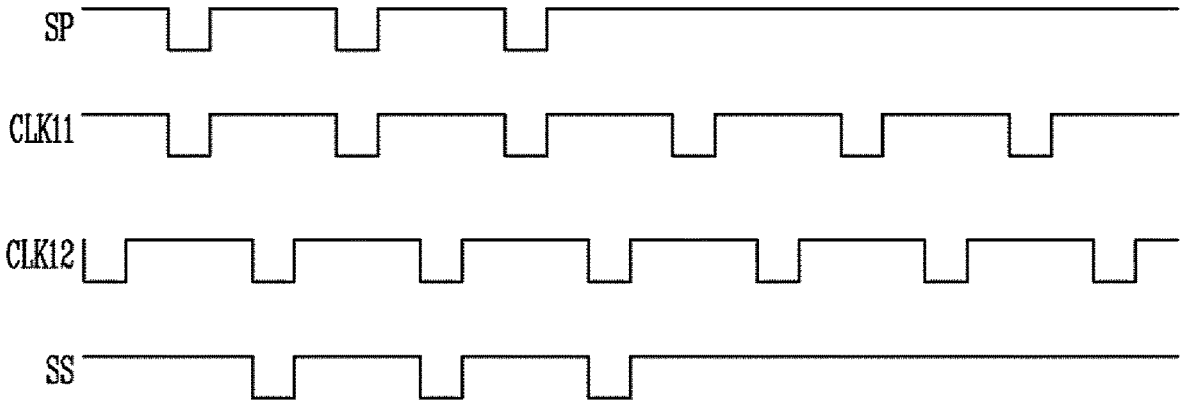

FIGS. 5A and 5B are diagrams illustrating an operation process of the stage shown in FIG. 4. For convenience of description, it is assumed that the twelfth clock signal CLK12 is a signal obtained by allowing the phase of the eleventh clock CLK11 to be shifted by a half period (½ period). In addition, for convenience of description, that each of the signals CLK11, CLK12, and GSP is supplied means that a low voltage is supplied.

Referring to FIG. 5A, when the stage ST is set as the first stage or the second stage, the gate start pulse GSP is supplied to the first input terminal 101.

If the gate start pulse GSP is supplied to the first input terminal 101 when the eleventh clock signal CLK11 is supplied to the second input terminal 102, the stage ST supplies, to the output terminal 104, the twelfth clock signal CLK12 input to the third input terminal 103 as the scan signal SS.

In an embodiment, when the gate start pulse GSP overlaps with three low voltages of the eleventh clock signals CLK11 as shown in FIG. 5A, the twelfth clock signal CLK12 is output to the output terminal 104, corresponding to the three low voltages. The twelfth clock signals CLK12 output to the output terminal 104 are supplied as the scan signals SS to the scan lines S1 and/or S2. In an embodiment, three scan signals SS are supplied to the scan lines S1 and/or S2.

Referring to FIG. 5B, when the stage ST is not the first stage or the second stage, the sampling pulse SP (i.e., the scan signal SS) of the previous stage is supplied to the first input terminal 101.

In an embodiment, when the sampling pulse SP overlaps with three low voltages of the eleventh clock signal CLK11 as shown in FIG. 5B, the twelfth clock signals CLK12 are output to the output terminal 104, corresponding to the three low voltages. The twelfth clock signals CLK12 output to the output terminal 104 are supplied as the scan signals SS to the scan lines S1 and/or S2. In an embodiment, three scan signals SS are supplied to the scan lines S1 and/or S2.

That is, when the first input terminal 101 and the second input terminal 102 are set to the low voltage, the stage ST supplies, to/through the output terminal 104, the low voltage supplied to the third input terminal 103. In an embodiment, the scan signal SS is used as the low voltage supplied to the output terminal 104.

In an embodiment, when the stage ST is driven as described above, the width of the gate start pulse GSP is controlled, so that the number of scan signals SS supplied to the output terminal 104 can be controlled.

The circuit structure of the stage ST may be implemented according to particular embodiments as long as the twelfth clock signal CLK12 supplied to the third input terminal 103 is supplied to the output terminal 104 when the eleventh clock signal CLK11 supplied to the second input terminal 102 overlaps with the sampling pulse SP or gate start pulse GSP supplied to the first input terminal 101. That is, the stage ST may be implemented with various types of circuits.

Figure 6:
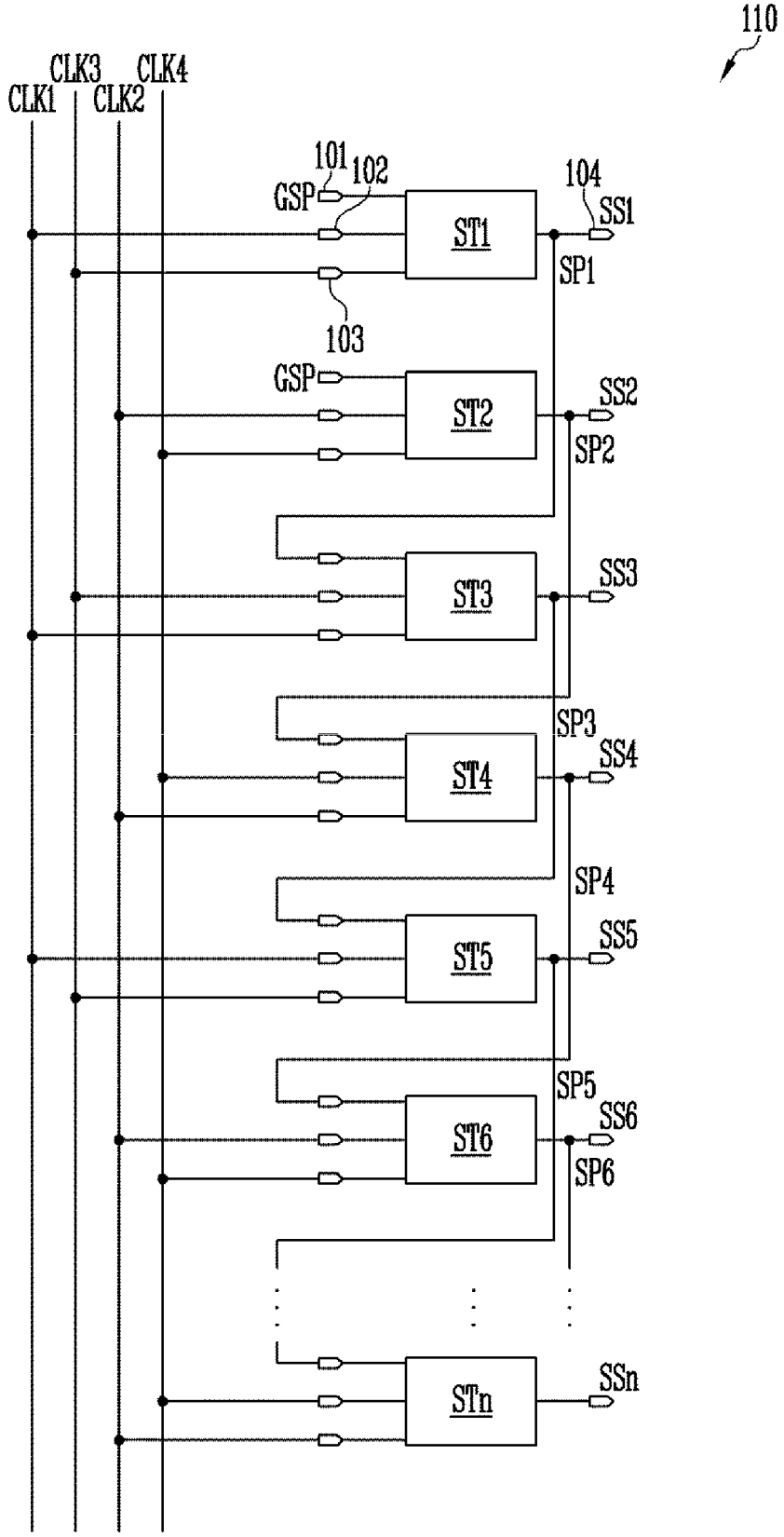
FIG. 6 is a circuit and/or block diagram illustrating a scan driver according to an embodiment.

FIG. 6 is a diagram illustrating a scan driver according to an embodiment.

Referring to FIG. 6, the scan driver 110 according to the embodiment includes a plurality of stages ST1, ST2, ST3, ST4, ST5, ST5, to STn for outputting scan signals SS.

A first clock signal CLK1 is supplied to the second input terminal 102 of a jth (j is 1, 5, 9, . . . ) stage STj, and a third clock signal CLK3 is supplied to the third input terminal 103 of the jth stage STj.

A second clock signal is supplied to the second input terminal 102 of a (j+1)th stage STj+1, and a fourth clock signal CLK4 is supplied to the third input terminal 103 of the (j+1)th stage STj+1.

The third clock signal CLK3 is supplied to the second input terminal 102 of a (j+2)th stage STj+2, and the first clock signal CLK1 is supplied to the third input terminal 103 of the (j+2)th stage STj+2.

The fourth clock signal CLK4 is supplied to the second input terminal 102 of a (j+3)th stage STj+3, and the second clock signal CLK2 is supplied to the third input terminal 103 of the (j+3)th stage STj+3.

A gate start pulse GSP is supplied to the first input terminals 101 of the first stage ST1 and the second stage ST2. In addition, the first input terminal 101 of each of the other stages ST3 to STn except the first stage ST1 and the second stage ST2 is supplied with a sampling pulse SP (or a scan signal) of a previous stage. For example, the first input terminal 101 of an ith stage STi is supplied with a sampling pulse SP of an (i−2)th stage STi−1.

Figure 7:
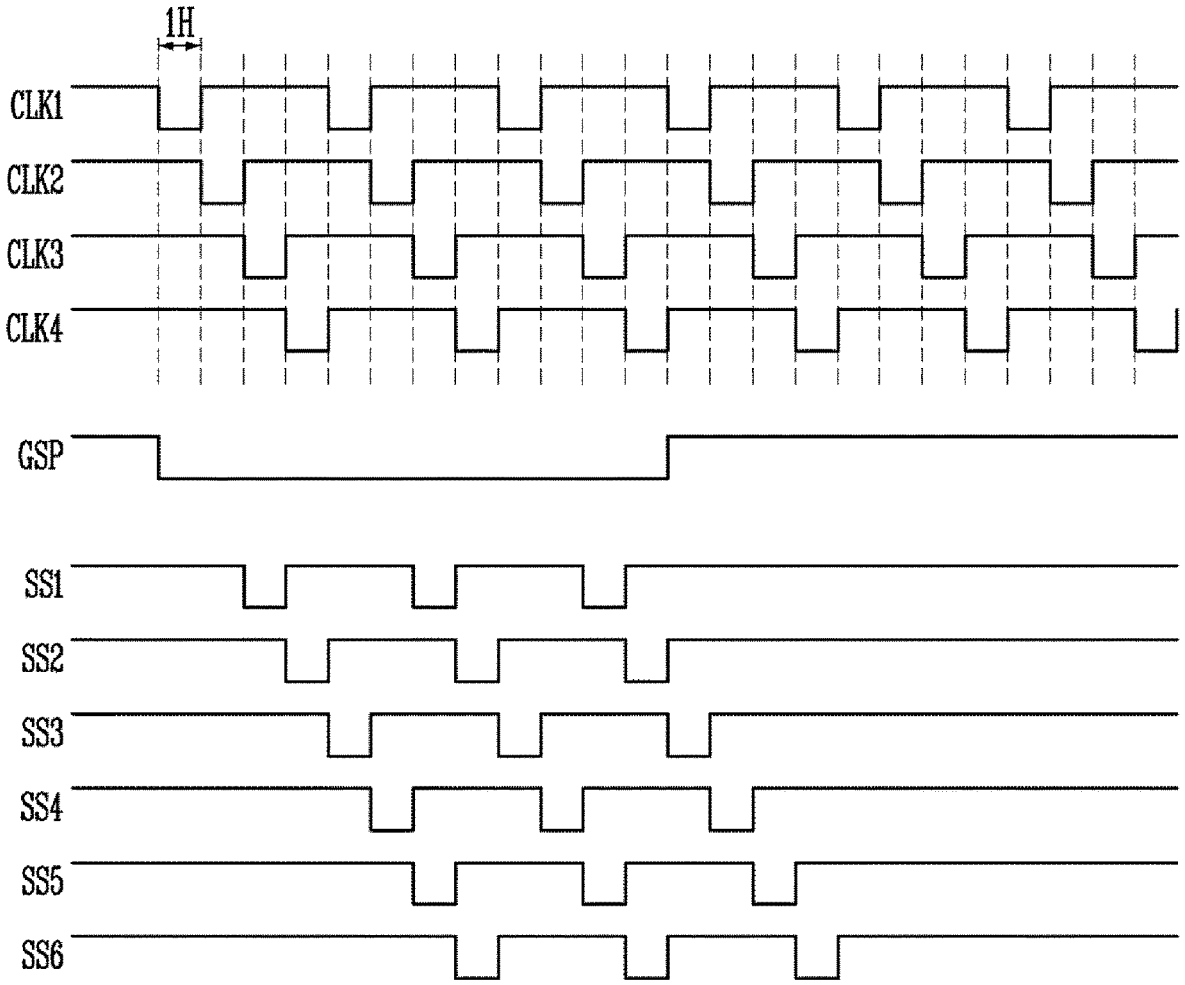
FIG. 7 is a waveform diagram illustrating an embodiment of an operation process of the scan driver shown in FIG. 6.

In an embodiment, as shown in FIG. 7, each of the first to fourth clock signals CLK1 to CLK4 is set as a signal that has the same period (e.g., 4H) and has a shifted phase. The length of the period may be equal to the sum of a CK1 signal duration, a CK2 signal duration, a CK3 signal duration, and a CK4 signal duration. For example, the first to fourth clock signals CLK1 to CLK4 are sequentially supplied, and each of the first to fourth clock signals CLK1 to CLK4 may be set such that its phase is shifted by ¼ period as compared with a previously supplied clock signal.

In other words, when the first to fourth clock signals CLK1 to CLK4 are sequentially supplied, the second clock signal CLK2 may be set such that its phase is shifted by ¼ period as compared with the first clock signal CLK1, the third clock signal CLK3 may be set such that its phase is shifted by ¼ period as compared with the second clock signal CLK2, and the fourth clock signal CLK4 may be set such that its phase is shifted by ¼ period as compared with the third clock signal CLK3.

FIG. 7 is a waveform diagram illustrating an embodiment of an operation process of the scan driver shown in FIG. 6.

Referring to FIG. 7, the gate start pulse GSP is supplied to overlap with three low voltages of each of the first clock signal CLK1 and the second clock signal CLK2.

If the gate start pulse GSP is supplied, the first stage ST1 supplies, to/through its output terminal 104, the third clock signal CLK3 supplied to its third input terminal 103 whenever the first clock signal CLK1 supplied to the second input terminal 102 overlaps with the gate start pulse GSP. The third clock signal CLK3 supplied to the output terminal 104 is used as a scan signal SS1.

If the gate start pulse GSP is supplied, the second stage ST2 supplies, to/through its output terminal 104, the fourth clock signal CLK4 supplied to its third input terminal 103 whenever the second clock signal CLK2 supplied to the second input terminal 102 overlaps with the gate start pulse GSP. The fourth clock signal CLK4 supplied to the output terminal 104 is used as a scan signal SS2.

The third stage ST3 is supplied with the scan signal SS1 of the first stage ST1 as a first sampling pulse SP1. If the first sampling pulse SP1 is supplied, the third stage ST3 supplies, to/through its output terminal 104, the first clock signal CLK1 supplied to its third input terminal 103 whenever the third clock signal CLK3 supplied to the second input terminal 102 overlaps with the first sampling pulse SP1. The first clock signal CLK1 supplied to the output terminal 104 is used as a scan signal SS3.

The fourth stage ST4 is supplied with the scan signal SS2 of the second stage ST2 as a second sampling pulse SP2. If the second sampling pulse SP2 is supplied, the fourth stage ST4 supplies, to/through its output terminal 104, the second clock signal CLK2 supplied to its third input terminal 103 whenever the fourth clock signal CLK4 supplied to the second input terminal 102 overlaps with the second sampling pulse SP2. The second clock signal CLK2 supplied to the output terminal 104 is used as a scan signal SS4.

In an embodiment, the stages ST1 to STn output scan signals SS1 to SSn while repeating the above-described process.

Figure 8A:
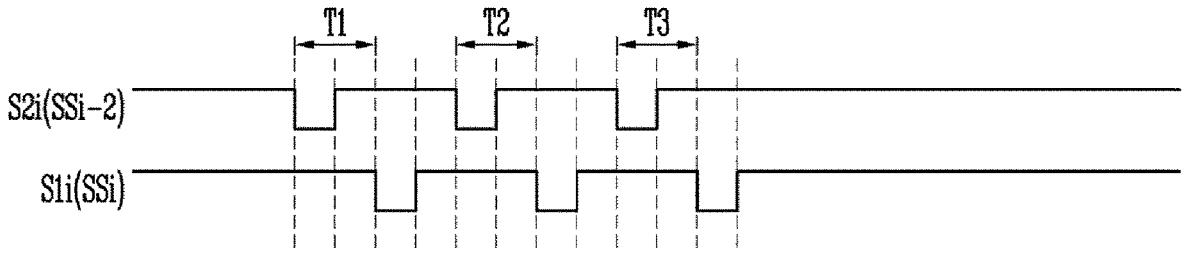
FIG. 8A and FIG. 8B are diagrams illustrating embodiments of scan signals supplied to a pixel located on an ith horizontal line (or ith pixel row) by the scan driver shown in FIG. 6.
Figure 8B:
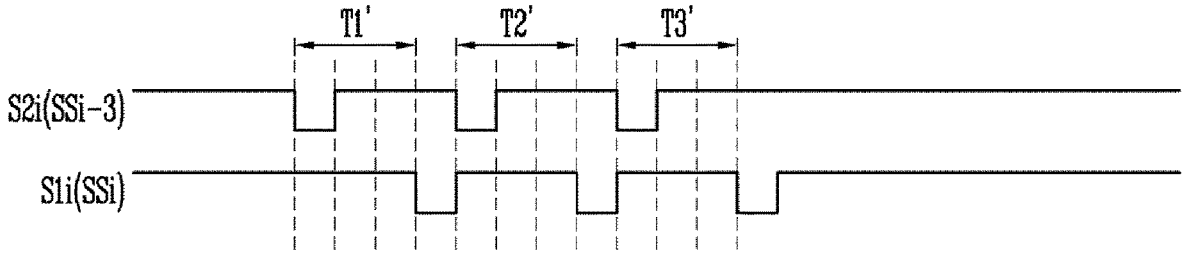

FIGS. 8A and 8B are diagrams illustrating embodiments of scan signals supplied to a pixel located on an ith horizontal line (or ith pixel row) by the scan driver shown in FIG. 6.

Referring to FIG. 8A, a scan signal SSi of an ith stage STi is supplied to the ith first scan line S1*i* coupled to the pixel PXL located on the ith horizontal line, and a scan signal SSi−2 of an (i−2)th stage STi−2 is supplied to the ith second scan line S2*i* coupled to the pixel PXL on the ith horizontal line.

If the scan signal SSi−2 is supplied to the ith second scan line S2*i*, the second transistor M2 is turned on. If the second transistor M2 is turned on, the voltage of the initialization power source Vint is supplied to the first node N1, and accordingly, the first transistor M1 is initialized to the on-bias state.

In an embodiment, since the scan signal SSi−2 of the (i−2)th stage STi−2 is supplied to the ith second scan line S2*i* and the scan signal SSi of the ith stage STi is supplied to the ith first scan line Si, the first transistor M1 is initialized to the on-bias state during/for a first period T1, a second period T2, and a third period T3. In an embodiment, each of the first period T1, the second period T2, and the third period T3 is set as a period of 2H (or two times the duration of a clock signal), and accordingly, the first transistor M1 is initialized to the on-bias state during/for a period of 6H.

As described above, if the first transistor M1 is set to the on-bias state during/for a relatively long period, the characteristic curve of the first transistor M1 is initialized to the on-bias state regardless of a data signal supplied in a previous frame period, and accordingly an image with uniform and/or satisfactory luminance can be implemented.

In other words, the scan driver 110 according to the embodiment supplies a plurality of scan signals to each of the second scan lines S2, and supplies the scan signal to the second scan line S2 located on the same horizontal line earlier by at least a period of 2H than the scan signal supplied to the first scan line S1. Accordingly, the characteristic curve of the first transistor M1 can be initialized to a certain desirable state.

Referring to FIG. 8B, the scan signal SSi of the ith stage STi is supplied to the ith first scan line S1*i* coupled to the pixel PXL located on the ith horizontal line, and a scan signal SSi−3 of an (i−3)th stage STi−3 is supplied to the ith second scan line S2*i* coupled to the pixel PXL located on the ith horizontal line.

If the scan signal SSi−3 is supplied to the ith second scan line S2*i*, the second transistor M2 is turned on. If the second transistor M2 is turned on, the voltage of the initialization power source Vint is supplied to the first node N1, and accordingly, the first transistor M1 is initialized to the on-bias state.

In an embodiment, since the scan signal SSi−3 of the (i−3)th stage STi−3 is supplied to the ith second scan line S2*i* and the scan signal SSi of the ith stage STi is supplied to the ith first scan line S1*i*, the first transistor M1 is initialized to the on-bias state during/for a first period T1', a second period T2', and a third period T3'. In an embodiment, each of the first period T1', the second period T2', and the third period T3' is set as a period of 3H, and accordingly, the first transistor M1 is initialized to the on-bias state during/for a period of 9H.

As described above, if the first transistor M1 is set to the on-bias state during a relatively long period, the characteristic curve of the first transistor M1 is initialized to the on-bias state regardless of a data signal supplied in a previous frame period, and accordingly an image with uniform and/or satisfactory luminance can be implemented.

In other words, the scan driver 110 according to the embodiment supplies a plurality of scan signals to each of the second scan lines S2, and supplies the scan signal to the second scan line S2 located on the same horizontal line earlier by at least a period of 3H than the scan signal supplied to the first scan line S1. Accordingly, the characteristic curve of the first transistor M1 can be initialized to a certain desirable state.

Figure 9:
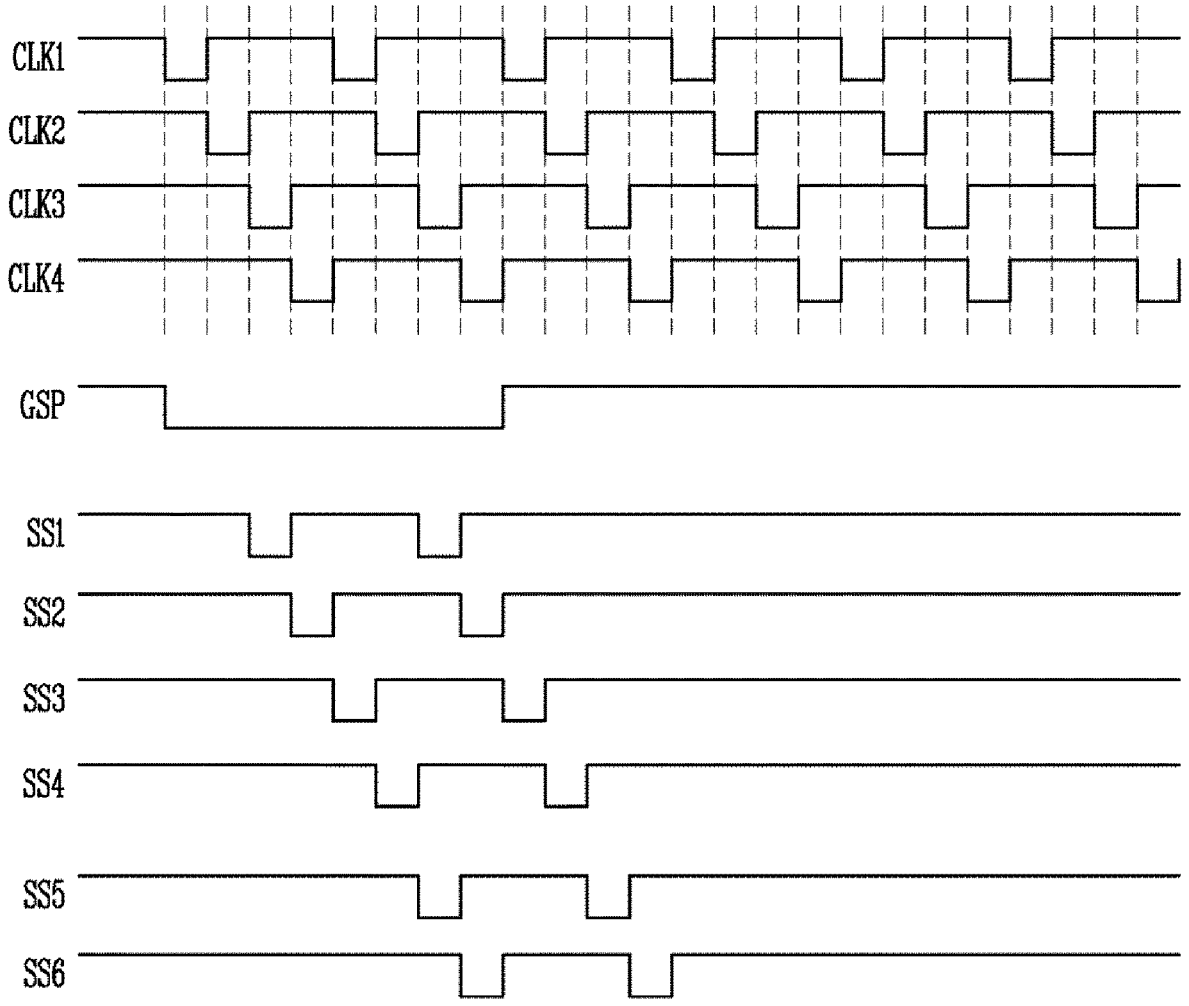
FIG. 9 is a waveform diagram illustrating an embodiment of the operation process of the scan driver shown in FIG. 6.

FIG. 9 is a waveform diagram illustrating an embodiment of the operation process of the scan driver shown in FIG. 6.

Referring to FIG. 9, the gate start pulse GSP is supplied to overlap with two low voltages of each of the first clock signal CLK1 and the second clock signal CLK2.

If the gate start pulse GSP is supplied, the first stage ST1 supplies, to the output terminal 104, the first clock signal CLK1 supplied to the third clock signal CLK3 supplied to the third input terminal 103 whenever the first clock signal CLK1 supplied to the second input terminal 102 overlaps with the gate start pulse GSP. The third clock signal CLK3 supplied to the output terminal 104 is used as the scan signal SS1.

If the gate start pulse GSP is supplied, the second stage ST2 supplies, to the output terminal 104, the fourth clock signal CLK4 supplied to the third input terminal 103 whenever the second clock signal CLK2 supplied to the second input terminal 102 overlaps with the gate start pulse GSP. The fourth clock signal CLK4 supplied to the output terminal 104 is used as the scan signal SS2.

The third stage ST3 is supplied with the scan signal SS1 of the first stage ST1 as a first sampling pulse SP1. If the first sampling pulse SP1 is supplied, the third stage ST3 supplies, to the output terminal 104, the first clock signal CLK1 supplied to the third input terminal 103 whenever the third clock signal CLK3 supplied to the second input terminal 102 overlaps with the first sampling pulse SP1. The first clock signal CLK1 supplied to the output terminal 104 is used as the scan signal SS3.

The fourth stage ST4 is supplied with the scan signal SS2 of the second stage ST2 as a second sampling pulse SP2. If the second sampling pulse SP2 is supplied, the fourth stage ST4 supplies, to the output terminal 104, the second clock signal CLK2 supplied to the third input terminal 103 whenever the fourth clock signal CLK4 supplied to the second input terminal 102 overlaps with the second sampling clock SP2. The second clock signal CLK2 supplied to the output terminal 104 is used as the scan signal SS4.

That is, the scan driver 110 according to the embodiment controls the width of the gate start pulse GSP, so that the number of scan signals SS supplied to each of the scan lines S1 and/or S2 can be controlled.

In an embodiment, in the above, a case where the stages ST of the scan driver 110 generate scan signals supplied to the first and second scan lines S1 and S2 is illustrated in FIG. 6. In an embodiment, a scan signal supplied to the first scan line and a scan signal supplied to the second scan line may be generated in stages different from each other.

Figure 10:
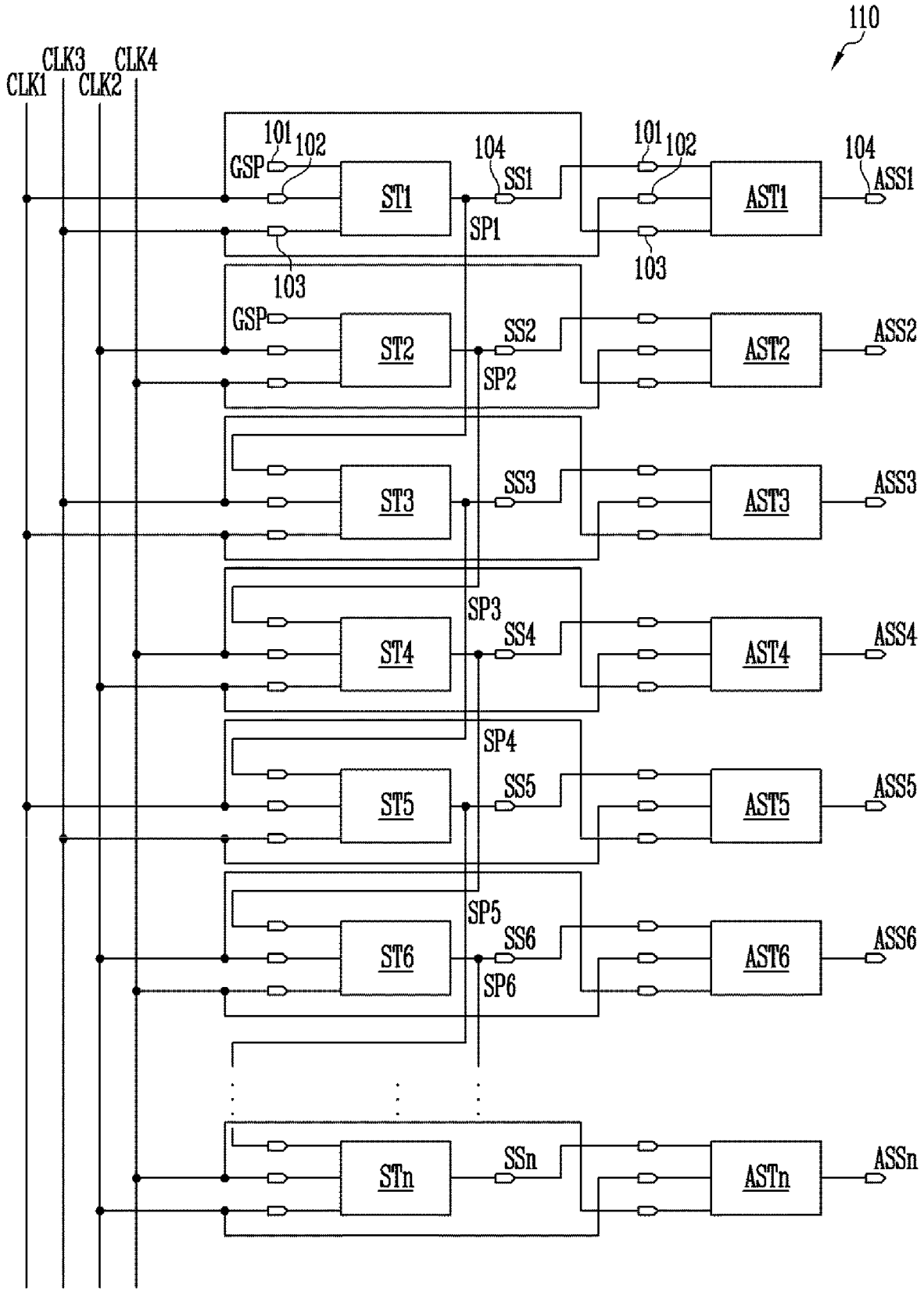
FIG. 10 is a diagram illustrating a scan driver according to an embodiment.

FIG. 10 is a diagram illustrating a scan driver according to an embodiment.

Referring to FIG. 10, the scan driver 110 according to the embodiment includes stages ST1 to STn and auxiliary stages AST1 to ASTn.

Figure 11:
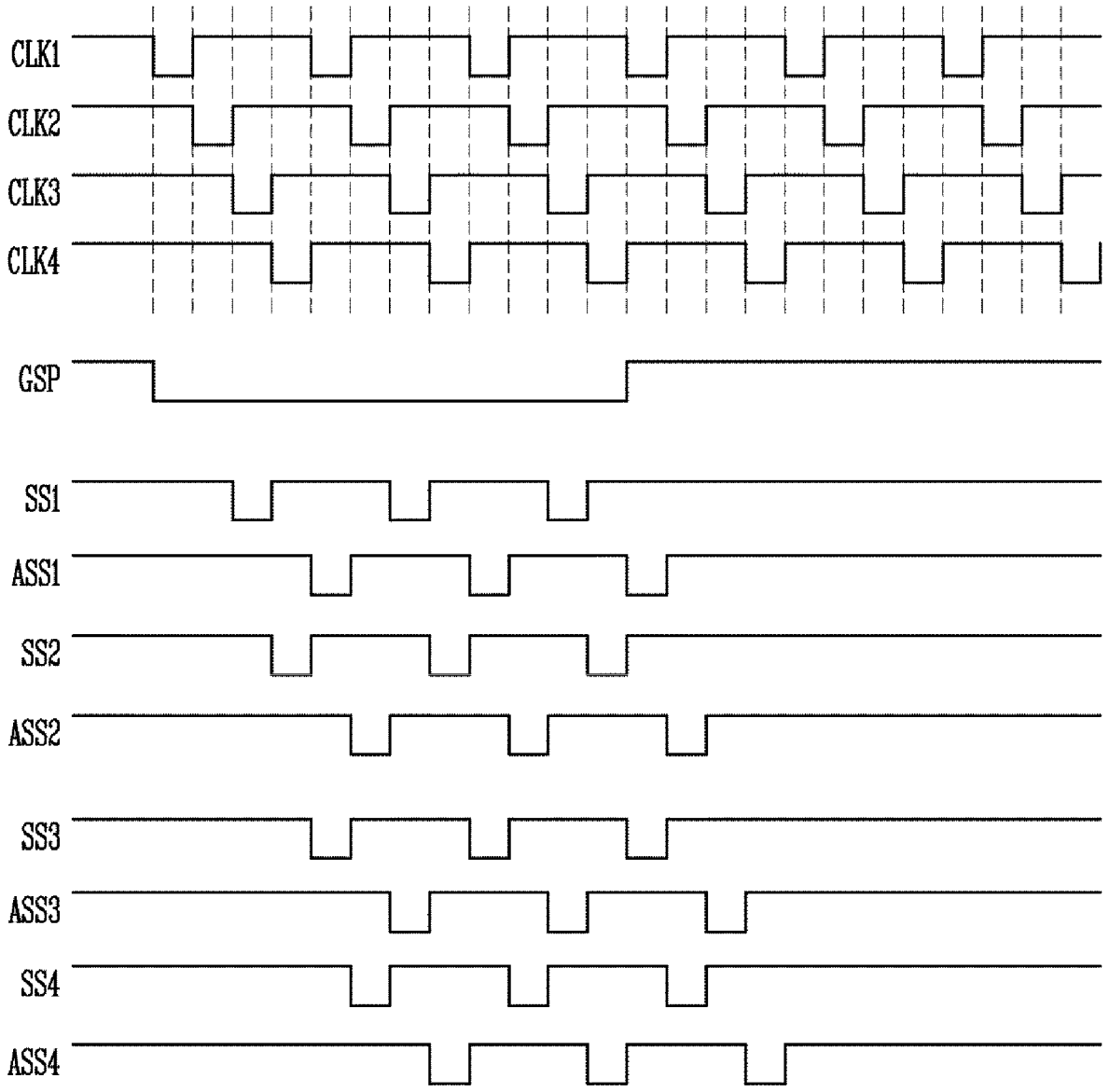
FIG. 11 is a waveform diagram illustrating an embodiment of an operation process of the scan driver shown in FIG. 10.

The stages ST1 to STn sequentially generate scan signals SS1 to SSn. The coupling relationship and driving method of the stages ST1 to STn are identical or analogous to those of the stages ST1 to STn described in FIG. 6. Therefore, the stages ST1 to STn output scan signals SS1 to SS4, corresponding to the width of a gate start pulse GSP as shown in FIG. 11. The stages ST1 to STn have been described with reference to FIG. 6. In an embodiment, each of the stages ST1 to STn is coupled to one of the second scan lines S2, and supplies a scan signal to the second scan line S2. For example, an ith stage ST may supply a scan signal to the ith second scan line S2*i*.

The auxiliary stages AST1 to ASTn sequentially generate scan signals ASS1 to ASSn. Each of the auxiliary stages AST1 to ASTn is coupled to one of the first scan lines S1, and supplies a scan signal to the first scan line S1. For example, an ith auxiliary stage ASTi may supply a scan signal to the ith first scan line S1*i*.

The circuit structure of the auxiliary stages AST1 to ASTn is set identically to that of the stages ST1 to STn. Therefore, when a low voltage is supplied to the first input terminal 101 and the second input terminal 102, each of the auxiliary stages AST1 to ASTn supplies, to/through its output terminal 104, a low voltage supplied to its third input terminal 103 as a scan signal ASS.

The first input terminal 101 of each of the auxiliary stage AST1 to ASTn is supplied with a scan signal SS of one of the stages ST1 to STn located on the same horizontal line as the auxiliary stage. For example, the scan signal SSi of the ith stage STi is supplied to the first input terminal 101 of the ith auxiliary stage ASTi.

The third clock signal CLK3 is supplied to the second input terminal 102 of the jth auxiliary stage ASTj, and the first clock signal CLK1 is supplied to the third input terminal 103 of the jth auxiliary stage ASTj. In an embodiment, a first auxiliary stage AST1 supplies, to the output terminal 104, the first clock signal CLK1 supplied to the third input terminal 103 whenever the third clock signal CLK3 supplied to the second input terminal 102 overlaps with the scan signal SS1. The first clock signal CLK1 supplied to the output terminal 104 is supplied to a first first scan line as a scan signal ASS1.

The fourth clock signal CLK4 is supplied to the second input terminal 102 of a (j+1)th auxiliary stage ASTj+1, and the second clock signal CLK2 is supplied to the third input terminal 103 of the (j+1)th auxiliary stage ASTj+1. In an embodiment, as shown in FIG. 11, a second auxiliary stage AST2 supplies, to the output terminal 104, the second clock signal CLK2 supplied to the third input terminal 103 whenever the fourth clock signal CLK4 supplied to the second input terminal 102 overlaps with the scan signal SS2. The second clock signal CLK2 supplied to the output terminal 104 is supplied to a second first scan line as a scan signal ASS2.

The first clock signal CLK1 is supplied to the second input terminal 102 of a (j+2)th auxiliary stage ASTj+2, and the third clock signal CLK3 is supplied to the second input terminal 102 of the (j+2)th auxiliary stage ASTj+2. In an embodiment, as shown in FIG. 11, a third auxiliary stage AST3 supplies, to the output terminal 104, the third clock signal CLK3 supplied to the third input terminal 103 whenever the first clock signal CLK1 supplied to the second input terminal 102 overlaps with the scan signal SS3. The third clock signal CLK3 supplied to the output terminal 104 is supplied to a third first scan line as a scan signal ASS3.

The second clock signal CLK2 is supplied to the second input terminal 102 of a (j+3)th auxiliary stage ASTj+3, and the fourth clock signal CLK4 is supplied to the third input terminal 103 of the (j+3)th auxiliary stage ASTj+3. In an embodiment, as shown in FIG. 11, a fourth auxiliary stage AST4 supplies, to the output terminal 104, the fourth clock signal CLK4 supplied to the third input terminal 103 whenever the second clock signal CLK2 supplied to the second input terminal 102 overlaps with the scan signal SS4. The fourth clock signal CLK4 supplied to the output terminal 104 is supplied to a fourth first scan line as a scan signal ASS4.

As described above, if scan signals are supplied to the first and second scan lines S1 and S2, the first transistor M1 included in each of the pixels PXL is initialized to the on-bias state during a period of 6H, and accordingly, an image with uniform luminance can be implemented.

In an embodiment, in the above, a case where a plurality of scan signals are supplied to the first scan lines S1 is illustrated in FIG. 11. In an embodiment, the first transistor M1 included in each of the pixels PXL is initialized to the on-bias state by a scan signal supplied to the second scan line S2. Thus, stable driving can be ensured even when at least one scan signal is supplied to the first scan line, corresponding to a data signal.

Figure 12:
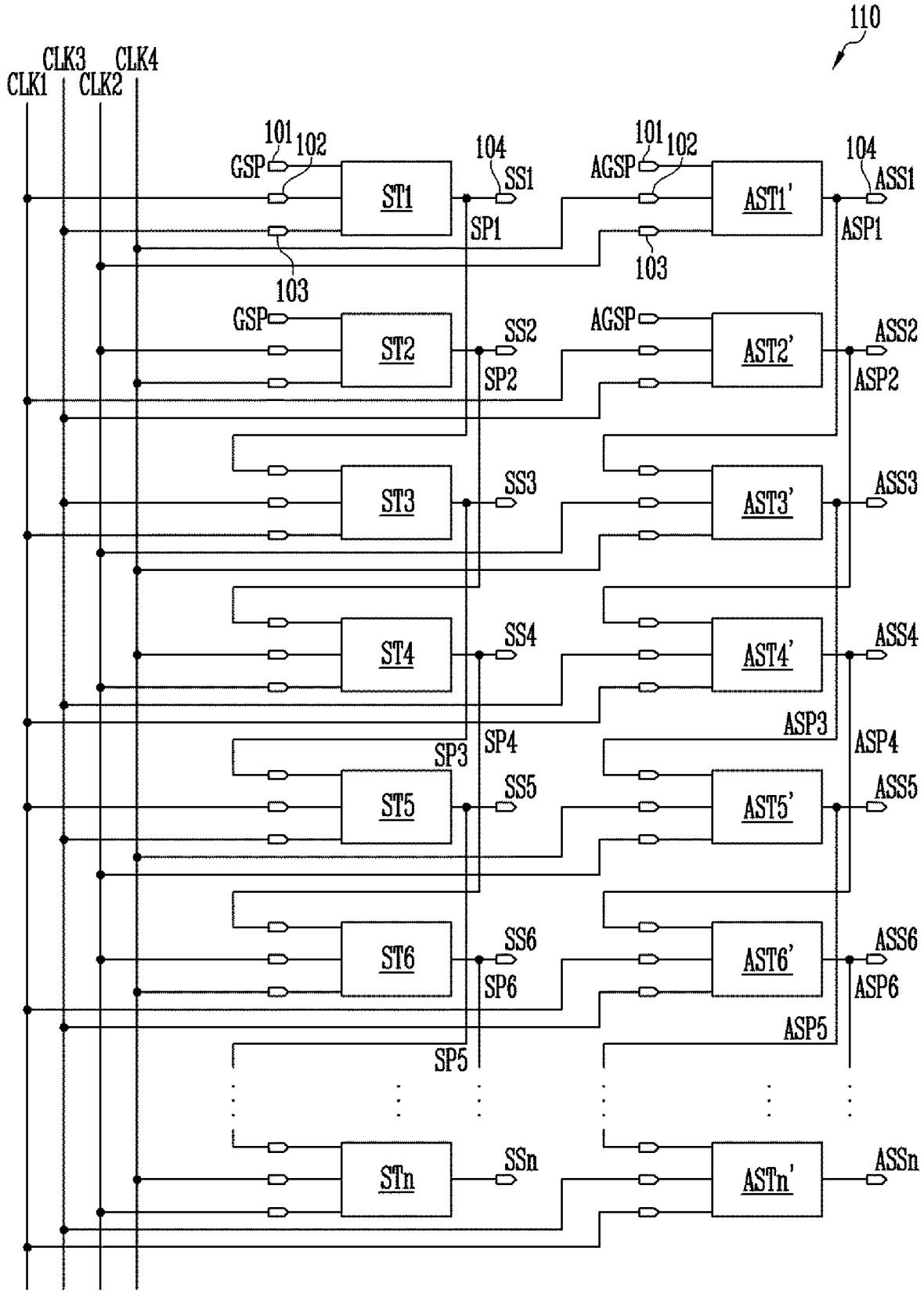
FIG. 12 is a diagram illustrating a scan driver according to an embodiment.

FIG. 12 is a diagram illustrating a scan driver according to an embodiment.

Referring to FIG. 12, the scan driver 110 according to the embodiment includes stages ST1 to STn and auxiliary stages AST1' to ASTn'.

Figure 13A:
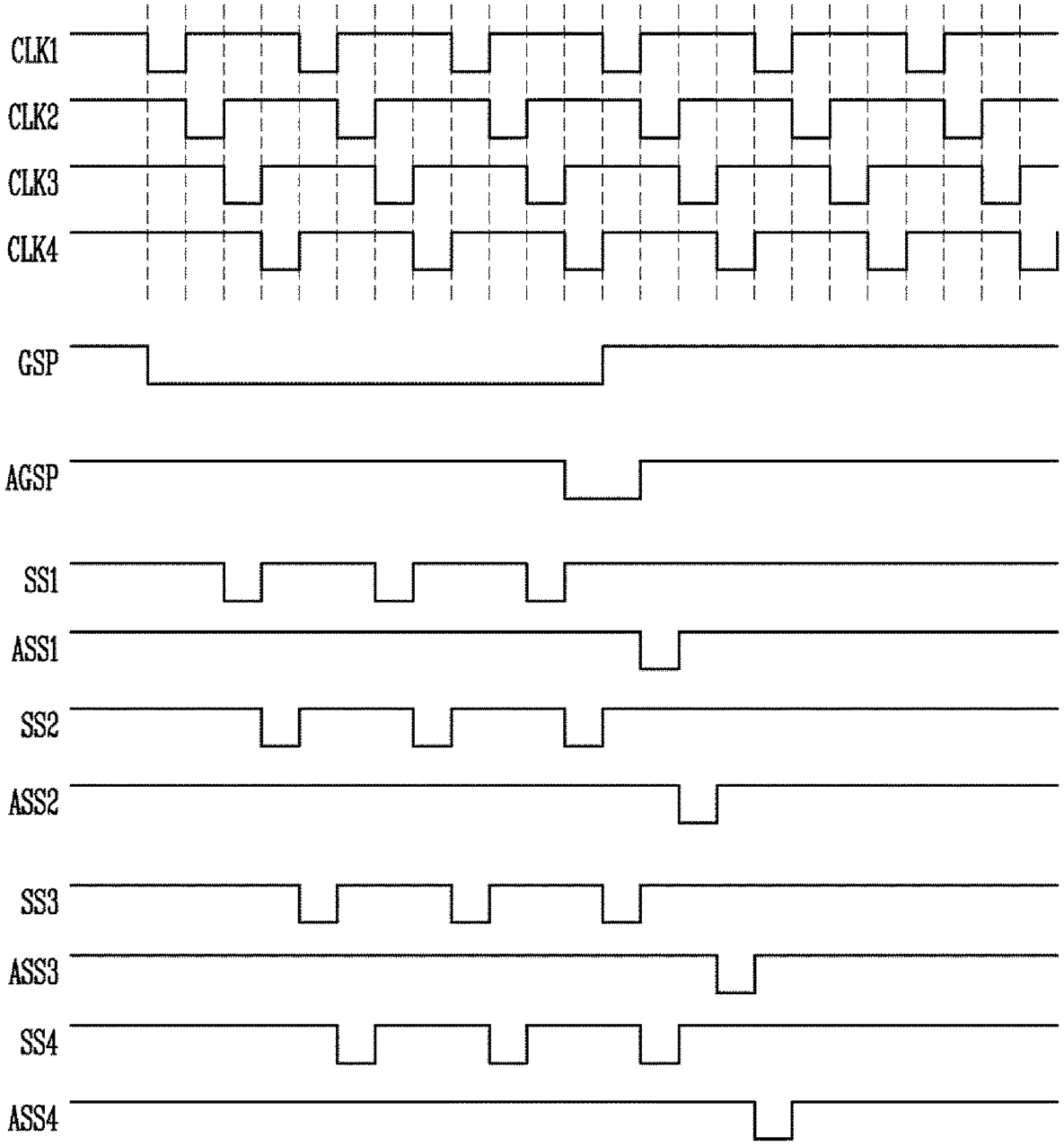
FIG. 13A and FIG. 13B are waveform diagrams illustrating embodiments of an operation process of the scan driver shown in FIG. 12.
Figure 13B:
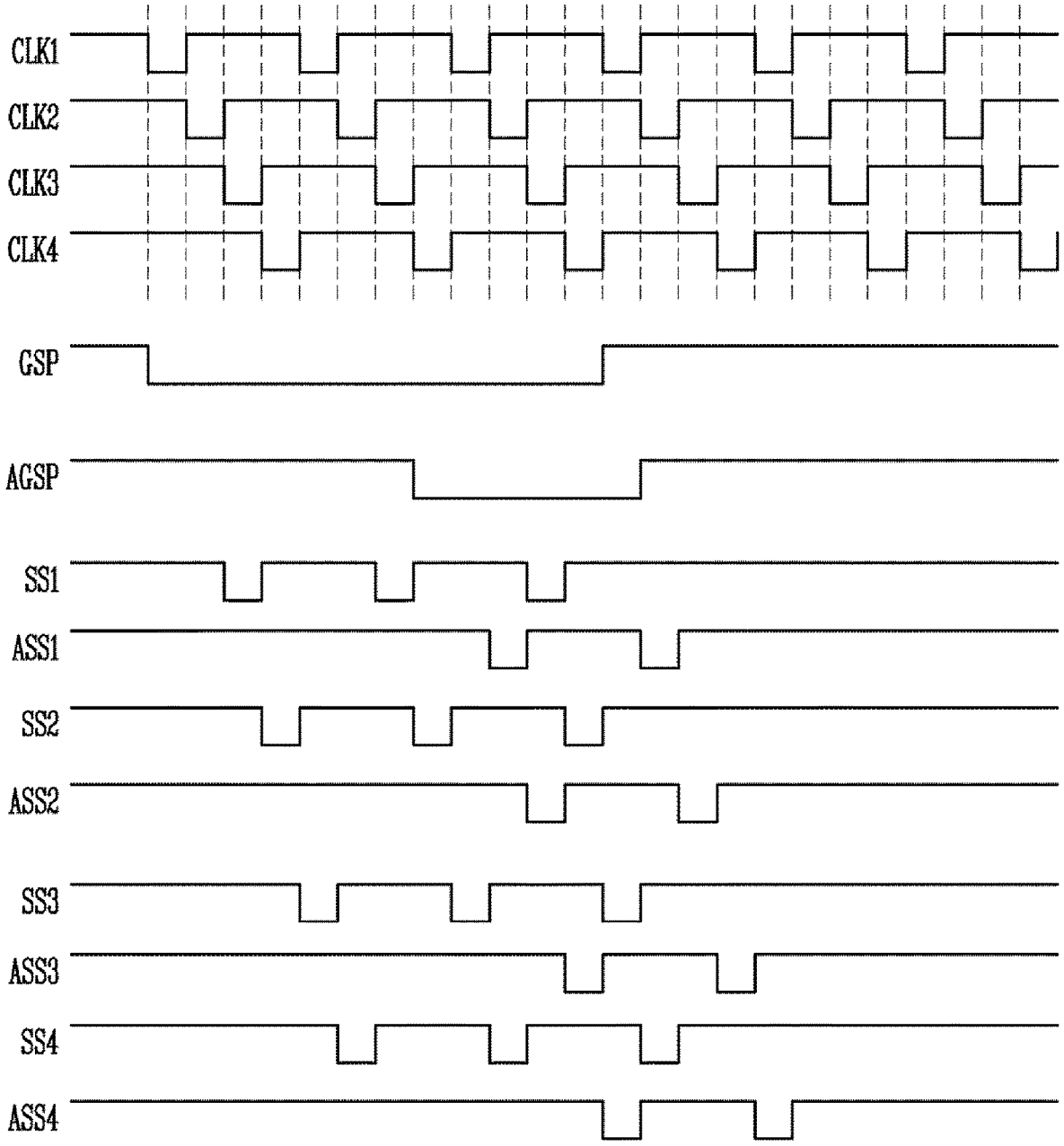

The stages ST1 to STn sequentially generate scan signals SS1 to SSn. The coupling relationship and driving method of the stages ST1 to STn are identical to those of the stages ST1 to STn described in FIG. 6. Therefore, the stages ST1 to STn output scan signals SS1 to SS4, corresponding to the width of a gate start pulse GSP as shown in FIGS. 13A and 13B. The stages ST1 to STn have been described with reference to FIG. 6, and therefore, their detailed descriptions will be omitted. However, each of the stages ST1 to STn is coupled to any one of the second scan lines S2, and supplies a scan signal to the second scan line S2. For example, an ith stage ST may supply a scan signal to the ith second scan line S2*i*.

The auxiliary stages AST1' to ASTn' sequentially generate scan signals ASS1 to ASSn. Each of the auxiliary stages AST1' to ASTn' is coupled to any one of the first scan lines S1, and supplies a scan signal to the first scan line S1. For example, an ith auxiliary stage ASTi' may supply a scan signal to the ith first scan line S1*i*.

The fourth clock signal CLK4 is supplied to the second input terminal 102 of a jth auxiliary stage ASTj', and the second clock signal CLK2 is supplied to the third input terminal 103 of the jth auxiliary stage ASTj'.

The first clock signal CLK1 is supplied to the second input terminal 102 of a (j+1)th auxiliary stage ASTj+1', and the third clock signal CLK3 is supplied to the third input terminal 103 of the (j+1)th auxiliary stage ASTj+1'.

The second clock signal CLK2 is supplied to the second input terminal 102 of a (j+2)th auxiliary stage ASTj+2', and the fourth clock signal CLK4 is supplied to the third input terminal 103 of the (j+2)th auxiliary stage ASTj+2'.

The third clock signal CLK3 is supplied to the second input terminal 102 of a (j+3)th auxiliary stage ASTj+3', and the first clock signal CLK1 is supplied to the third input terminal 103 of the (j+3)th auxiliary stage ASTj+3'.

An auxiliary gate start pulse AGSP is supplied to the first input terminal 101 of each of the first auxiliary stage AST1' and the second auxiliary stage AST2'. In addition, the first input terminal 101 of each of the other auxiliary stages AST3' to ASTn' except the first auxiliary stage AST1' and the second auxiliary stage AST2' is supplied with a sampling signal ASP (or a scan signal) of a previous auxiliary stage. For example, a sampling pulse ASP of an (i−2)th auxiliary stage ASTi−2' is supplied to the first input terminal 101 of an ith auxiliary stage AST1'.

In the scan driver 110 according to the embodiment, the auxiliary stages AST1' to ASTn' are controlled by the auxiliary gate start pulse AGSP. Thus, as shown in FIGS. 13A and 13B, the number of scan signals ASS supplied to each of the first scan lines S1 is controlled corresponding to the width of the auxiliary gate start pulse ASGP.

In more detail, the first auxiliary stage AST1' supplies, to the output terminal 104, the second clock signal CLK2 supplied to the third input terminal 103 whenever the fourth clock signal CLK4 supplied to the second input terminal 102 overlaps with the auxiliary gate start pulse AGSP. The second clock signal CLK2 supplied to the output terminal 104 is supplied to the first first scan line as the scan signal ASS1.

The second auxiliary stage AST2' supplies, to the output terminal 104, the third clock signal CLK3 supplied to the third input terminal 103 whenever the first clock signal CLK1 supplied to the second input terminal 102 overlaps with the auxiliary gate start pulse AGSP. The third clock signal CLK3 supplied to the output terminal 104 is supplied to the second first scan line as the scan signal ASS2.

The third auxiliary stage AST3' supplies, to the output terminal 104, the fourth clock signal CLK4 supplied to the third input terminal 103 whenever the second clock signal CLK2 supplied to the second input terminal 102 overlaps with a sampling pulse ASP1. The fourth clock signal CLK4 supplied to the output terminal 104 is supplied to the third first scan line as the scan signal ASS3.

The fourth auxiliary stage AST4' supplies, to the output terminal 104, the first clock signal CLK1 supplied to the third input terminal 103 whenever the third clock signal CLK3 supplied to the second input terminal 102 overlaps with a sampling pulse ASP2. The first clock signal CLK1 supplied to the output terminal 104 is supplied to the fourth first scan line as the scan signal ASS4.

In an embodiment, the scan driver 110 supplies scan signals while repeating the above-described process.

In an organic light emitting display device and a driving method thereof according to embodiments, the driving transistor is initialized to the on-bias state at least twice before a desired data signal is supplied, and accordingly, an image with a desired luminance can be displayed regardless of a data signal supplied in a previous frame period. In embodiments, the on-bias state of the driving transistor is set to at least two horizontal periods by controlling the supplying timing of a scan signal, and accordingly, the characteristic of the driving transistor can be stably initialized.

Example embodiments have been disclosed herein, and although specific terms are employed, they are used and are to be interpreted in a generic and descriptive sense and not for purpose of limitation. In some instances, features, characteristics, and/or elements described in connection with a particular embodiment may be used singly or in combination with features, characteristics, and/or elements described in connection with other embodiments unless otherwise specifically indicated. Various changes in form and details may be made without departing from the spirit and scope set forth in the following claims.

What is claimed is:

1. An organic light emitting display device comprising:

a pixel comprising a first transistor, a second transistor, and a third transistor, wherein a source electrode of the first transistor is electrically connected to a drain electrode of the third transistor, and wherein a drain electrode of the second transistor is configured to receive an initialization voltage;

a data line electrically connected to a source electrode of the third transistor and configured to transmit a data signal with a voltage higher than the initialization voltage;

a first scan line electrically connected to a gate electrode of the third transistor;

a second scan line electrically connected to a gate electrode of the second transistor; and a scan driver electrically connected to each of the first scan line and the second scan line and configured to provide an initializing scan signal to the second scan line at least two horizontal periods before providing an initial scan signal to the first scan line, wherein a length of each of the two horizontal periods is equal to a duration of the initializing scan signal, wherein the scan driver comprises a first stage, wherein a first input terminal of the first stage is configured to receive a first input signal, wherein a second input terminal of the first stage is configured to receive a first copy of a first clock signal, wherein a third input terminal of the first stage is configured to receive a first copy of a second clock signal, wherein an output terminal of the first stage is configured to output a first scan signal after the first input terminal of the first stage has received the first input signal and the second input terminal of the first stage has received the first copy of the first clock signal, wherein the first scan signal is equal to at least one of the second clock signal and the initializing scan signal, wherein the scan driver comprises a second stage, a third stage, and a fourth stage, wherein a first input terminal of the second stage is configured to receive a second input signal, wherein a second input terminal of the second stage is configured to receive a first copy of a third clock signal, wherein a third input terminal of the second stage is configured to receive a first copy of a fourth clock signal, wherein an output terminal of the second stage is configured to output a second scan signal after the first input terminal of the second stage has received the second input signal and the second input terminal of the second stage has received the first copy of the third clock signal, wherein the second scan signal is equal to the fourth clock signal, wherein a first input terminal of the third stage is configured to receive a copy of the first scan signal, wherein a second input terminal of the third stage is configured to receive a second copy of a second clock signal, wherein a third input terminal of the third stage is configured to receive a second copy of a first clock signal, wherein an output terminal of the third stage is configured to output a third scan signal after the first input terminal of the third stage has received the copy of the first scan signal and the second input terminal of the third stage has received the second copy of the second clock signal, wherein the third scan signal is equal to the first clock signal, wherein a first input terminal of the fourth stage is configured to receive a copy of the second scan signal, wherein a second input terminal of the fourth stage is configured to receive a second copy of a fourth clock signal, wherein a third input terminal of the fourth stage is configured to receive a second copy of a third clock signal, wherein an output terminal of the fourth stage is configured to output a fourth scan signal after the first input terminal of the fourth stage has received the copy of the second scan signal and the second input terminal of the fourth stage has received the second copy of the fourth clock signal, wherein the fourth scan signal is equal to the third clock signal, wherein the output terminal of the first stage is electrically connected to the second scan line, and wherein the output terminal of the fourth stage is electrically connected to the first scan line.

2. An organic light emitting display device comprising:

a pixel comprising a first transistor, a second transistor, and a third transistor, wherein a source electrode of the first transistor is electrically connected to a drain electrode of the third transistor, and wherein a drain electrode of the second transistor is configured to receive an initialization voltage;

a data line electrically connected to a source electrode of the third transistor and configured to transmit a data signal with a voltage higher than the initialization voltage;

a first scan line electrically connected to a gate electrode of the third transistor;

a second scan line electrically connected to a gate electrode of the second transistor; and a scan driver electrically connected to each of the first scan line and the second scan line and configured to provide an initializing scan signal to the second scan line at least two horizontal periods before providing an initial scan signal to the first scan line, wherein a length of each of the two horizontal periods is equal to a duration of the initializing scan signal, wherein the scan driver comprises a first stage, wherein a first input terminal of the first stage is configured to receive a first input signal, wherein a second input terminal of the first stage is configured to receive a first copy of a first clock signal, wherein a third input terminal of the first stage is configured to receive a first copy of a second clock signal, wherein an output terminal of the first stage is configured to output a first scan signal after the first input terminal of the first stage has received the first input signal and the second input terminal of the first stage has received the first copy of the first clock signal, wherein the first scan signal is equal to at least one of the second clock signal and the initializing scan signal, wherein the scan driver comprises a second stage, a third stage, and a fourth stage, wherein a first input terminal of the second stage is configured to receive a second input signal, wherein a second input terminal of the second stage is configured to receive a first copy of a third clock signal, wherein a third input terminal of the second stage is configured to receive a first copy of a fourth clock signal, wherein an output terminal of the second stage is configured to output a second scan signal after the first input terminal of the second stage has received the second input signal and the second input terminal of the second stage has received the first copy of the third clock signal, wherein the second scan signal is equal to the fourth clock signal, wherein a first input terminal of the third stage is configured to receive a copy of the first scan signal, wherein a second input terminal of the third stage is configured to receive a second copy of a second clock signal, wherein a third input terminal of the third stage is configured to receive a second copy of a first clock signal, wherein an output terminal of the third stage is configured to output a third scan signal after the first input terminal of the third stage has received the copy of the first scan signal and the second input terminal of the third stage has received the second copy of the second clock signal, wherein the third scan signal is equal to the first clock signal, wherein a first input terminal of the fourth stage is configured to receive a copy of the second scan signal, wherein a second input terminal of the fourth stage is configured to receive a second copy of a fourth clock signal, wherein a third input terminal of the fourth stage is configured to receive a second copy of a third clock signal, wherein an output terminal of the fourth stage is configured to output a fourth scan signal after the first input terminal of the fourth stage has received the copy of the second scan signal and the second input terminal of the fourth stage has received the second copy of the fourth clock signal, wherein the fourth scan signal is equal to the third clock signal, wherein the scan driver further comprises a plurality of auxiliary stages, wherein an output terminal of each auxiliary stage of the auxiliary stages is configured to provide a scan signal after a first input terminal of the auxiliary stage and a second input terminal have each received a signal, and wherein the scan signal is equal to a clock signal received by a third terminal of the auxiliary stage.

3. The organic light emitting display device of claim 2, wherein the auxiliary stages include a first auxiliary stage, a second auxiliary stage, a third auxiliary stage, and a fourth auxiliary stage, wherein the first input terminals of the first, second, third, fourth auxiliary stages are respectively electrically connected to the output terminals of the first, second, third, fourth stages, wherein the second input terminals of the first, second, third, fourth auxiliary stages are respectively electrically connected to the third input terminals of the first, second, third, fourth stages, and wherein the third input terminals of the first, second, third, fourth auxiliary stages are respectively electrically connected to the second input terminals of the first, second, third, fourth stages.

4. The organic light emitting display device of claim 3, wherein the output terminal of the first stage is electrically connected to the second scan line, and wherein the output terminal of the first auxiliary stage is electrically connected to the first scan line.

5. The organic light emitting display device of claim 2, wherein the auxiliary stages include a first auxiliary stage, a second auxiliary stage, a third auxiliary stage, and a fourth auxiliary stage, wherein the second input terminal of the first auxiliary stage is configured to receive a third copy of the fourth clock signal, wherein the third input terminal of the first auxiliary stage is configured to receive a third copy of the third clock signal, wherein the second input terminal of the second auxiliary stage is configured to receive a third copy of the first clock signal, wherein the third input terminal of the second auxiliary stage is configured to receive a third copy of the second clock signal, wherein the second input terminal of the third auxiliary stage is configured to receive a third copy of the third clock signal, wherein the third input terminal of the third auxiliary stage is configured to receive a third copy of the fourth clock signal, wherein the second input terminal of the fourth auxiliary stage is configured to receive a third copy of the second clock signal, and wherein the third input terminal of the fourth auxiliary stage is configured to receive a third copy of the first clock signal.

6. The organic light emitting display device of claim 5, wherein the first input terminal of the first auxiliary stage and the first input terminal of the second auxiliary stage are configured to each receive a gate start pulse, wherein the first input terminal of the third auxiliary stage is electrically connected to the output terminal of the first auxiliary stage, and wherein the first input terminal of the fourth auxiliary stage is electrically connected to the output terminal of the second auxiliary stage.

7. The organic light emitting display device of claim 5, wherein the output terminal of the first stage is electrically connected to the second scan line, and wherein the output terminal of the first auxiliary stage is electrically connected to the first scan line.

* * * * *